United States Patent [19]

Gainer et al.

[11] 4,077,848

[45] Mar. 7, 1978

[54] METHOD AND APPARATUS FOR APPLYING PATCHING OR SEALING COMPOSITIONS TO COKE OVEN SIDE WALLS AND ROOF

[75] Inventors: Larry G. Gainer, Elizabeth Township, Allegheny County; Thomas G. Wylie, Whitehall Borough, Allegheny County, both of Pa.

[73] Assignee: United States Steel Corporation, Pittsburgh, Pa.

[21] Appl. No.: 749,596

[22] Filed: Dec. 10, 1976

[51] Int. Cl.[2] ..... C10B 29/02; F27D 1/16

[52] U.S. Cl. ..... 201/41; 202/239; 202/262; 202/270; 264/30

[58] Field of Search ..... 201/41; 202/239, 262, 202/267, 270; 264/30

[56] References Cited

U.S. PATENT DOCUMENTS

| | | | |
|---|---|---|---|
| 3,351,289 | 11/1967 | Demaison | 264/30 X |
| 3,413,385 | 11/1968 | Komac et al. | 264/30 |
| 3,957,203 | 5/1976 | Bullard | 239/165 X |

*Primary Examiner*—Morris O. Wolk
*Assistant Examiner*—Arnold Turk
*Attorney, Agent, or Firm*—Walter P. Wood

[57] ABSTRACT

Method and apparatus for applying patching or sealing compositions to the interior side walls and roof of a coke oven. In service the refractory of the side walls and roof develops cracks which need to be sealed. According to the invention, a gunning apparatus is mounted on the pusher machine. The head of the pusher ram carries a spray nozzle connected through pipes and a flexible hose with a gun tank mounted on the pusher machine chassis. The patching or sealing composition is applied immediately after coke is pushed from the oven by running the ram through the empty oven without waiting for the oven to cool.

8 Claims, 1 Drawing Figure

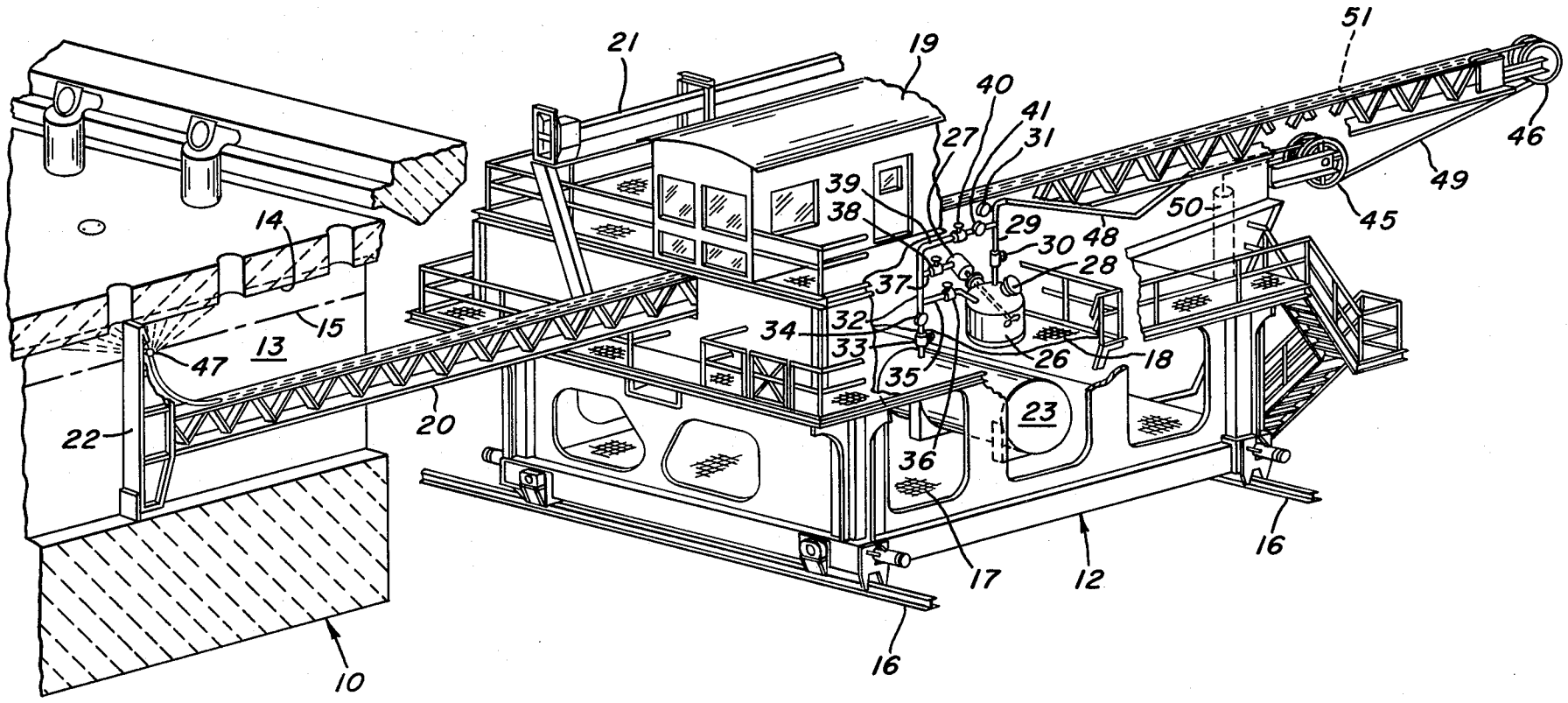
46
49
45
51
50
48
28
18
16
12
23
26
30
29
41
31
40
27
19
17
36
35
37
39
38
32
33
34
16
21
20
10
15
14
13
47
22

METHOD AND APPARATUS FOR APPLYING PATCHING OR SEALING COMPOSITIONS TO COKE OVEN SIDE WALLS AND ROOF

This invention relates to an improved method and apparatus for applying patching or sealing compositions to the interior side walls and roof of a coke oven.

A conventional battery of coke ovens includes a plurality of externally heated refractory lined ovens which are relatively tall and narrow and are arranged one next to the other. The ovens have removable doors at opposite sides of the battery, known as the pusher side and the coke side. A pusher machine, which includes a door extractor, a pusher ram, and a leveler bar, runs along a track at the pusher side. When a charge of coke within each oven is ready to be removed, the pusher machine removes the door at the pusher side, another machine removes the corresponding door at the coke side, and the pusher ram is used to push the charge from the oven into a quench car. The doors are then replaced and the oven charged with coal to repeat the operation.

Each side wall of a conventional oven has a respective horizontal flue located a little below the coke line. Cracks often develop in the refractory of the side walls above the base of the horizontal flue and in the roof of the oven. Such cracks require patching or sealing. The usual practice in patching or sealing cracks in the walls and roof has been to let the oven cool somewhat after a charge of coke has been pushed, and apply a refractory composition to the areas subject to cracking with a suitable gunning apparatus. The gunning apparatus may be held manually or mounted on a vehicle. Reference can be made to Komac et al U.S. Pat. No. 3,413,385 for a showing of a manually held gunning apparatus or to Bullard U.S. Pat. No. 3,957,203 for a showing of a gunning apparatus mounted on a vehicle. These patents also furnish more detailed discussions of the problem involved in applying patching or sealing composition to coke oven walls and roof.

When a manually held gunning apparatus is used, it is necessary to cool the oven to an undesirable extent so that a workman may approach closely enough to work on the cracked areas. This not only is time-consuming, but also is harmful to the refractories of the oven. Previous vehicle-mounted gunning apparatus have necessitated the use of a separate vehicle which must be brought into position adjacent the oven, likewise time-consuming operations. After the patching or sealing operation has been completed, the vehicle must be removed and the pusher machine returned to replace the door.

An object of the present invention is to provide an improved method and apparatus for applying patching or sealing compositions to the side walls and roof of a coke oven in which the gunning apparatus is mounted directly on a pusher machine, thereby overcoming difficulties encountered in past practice.

A further object is to provide an improved method of applying patching or sealing compositions to the side walls and roof of a coke oven in which the composition is applied after a pushing operation simply by passing the pusher ram through the empty oven and spraying the composition on the areas subject to cracking from a nozzle mounted on the same ram head.

In the drawing:

The single FIGURE is a cut-away diagrammatic perspective view of a portion of a coke oven and pusher machine in which a gunning apparatus is mounted on the pusher machine in accordance with our invention.

The FIGURE shows a portion of a conventional coke oven 10 and pusher machine 12. The oven 10 is one of a battery of a plurality of similar ovens. The oven has side walls 13 and a roof 14 formed of suitable refractory. The side walls contain horizontal flues, the location of which is indicated by a line 15. The refractories in the areas of the side walls 13 above the line 15 and in the roof are subject to cracking. The pusher machine 12 runs on tracks 16 alongside the pusher side of the battery. The pusher machine has a chassis which provides lower and upper platforms 17 and 18, and it includes the usual control cab 19, pusher ram 20, leveler bar 21, door extractor (not shown) and other conventional parts. The ram has a head 22 for engaging a coke charge and pushing it from the oven. The lower platform 17 carries a compressed air receiver 23.

In accordance with our invention, we mount a gun tank 26 on the upper platform 18, preferably over the air receiver 23. The gun tank is equipped with a stirring device 27, and it has a filling opening 28 and an upwardly extending outlet pipe 29, which has a valve 30 and a pressure gauge 31. A pipe 32 leads from the air receiver and has a valve 33 and pressure regulator 34. A first branch pipe 35, which has a valve 36, extends from pipe 32 to the gun tank 26. In the apparatus illustrated, the stirring device 27 is driven by an air operated motor. A second branch pipe 37, which has a valve 38, extends from pipe 32 to the drive motor of the stirring device. A third branch pipe 39, which has a valve 40 and a direct reading flowmeter 41, extends from pipe 32 to pipe 29. The gun tank itself is a known device available commercially from Quigley Company, Inc. and hence is not described in more detail.

We mount a hose reel 45 on the pusher machine behind the gun tank 26 directly under the ram 20. We mount a pulley 46 on the back end of the ram, and a spray nozzle 47 on the ram head 22 in a location to preferably direct spray against the sidewalls above the line 15 and the roof. Additional spray nozzles may be located on the ram head to spray other locations on the sidewalls as desired. A rigid pipe 48 extends from the upper end of the outlet pipe 29 to a location under the ram 20 adjacent the hose reel 45. We connect a flexible hose 49 to pipe 48 through a suitable swivel. The hose winds on reel 45, which has an automatic take-up illustrated as a counterweight 50. The hose extends back around pulley 46 to the top of ram 20. A pipe 51 extends the length of ram 20 and is connected at its opposite ends to the hose 49 and to the spray nozzle 47. The nozzle has outlets to spray material against the side walls 13 above the line 15 and against the roof 14 of the oven. When we use the apparatus during cold weather, we may wrap the various pipes and the hose with heating coils to assure that the composition flows freely.

According to the method of our invention, we charge the gun tank 26 with any suitable patching or sealing composition. Examples are hydraulic cements and various silicate materials. A suitable composition is available commercially from Quigley Company, Inc. under the trademark "Alsil 45." Water is added as also known in the art. Since patching or sealing compositions suitable for gunning are well known, no detailed disclosure is deemed necessary.

After coke has been pushed from the oven and the ram 20 retracted, an operator at the gun tank 26 opens valve 30 to start the flow of the composition. As soon as a spray is established from the nozzle 47, an operator in the cab 19 projects the ram through the empty oven and retracts it. As the ram is projected, the hose 49 unwinds from the reel 45, and as the ram is retracted the reel automatically takes up the hose. The pipes 29 and 48, hose 49 and pipe 51 carry the composition from the gun tank 26 to the spray nozzle 47 from which it is applied to the side walls and roof of the oven or at least one of the projecting and retracting strokes of the ram. Retraction of the ram is stopped before the ram head 22 leaves the oven, and the gun operator closes valve 30 to shut off delivery of the composition and opens valve 40 to direct air through the pipes, hose and nozzle. This air serves to purge the parts of the composition. Once the system is purged, the ram is returned to its home position and the purge air shut off. The system may be automated by suitable controls to permit operation solely by the pusher machine operator.

From the foregoing description it is seen that our invention enables patching or sealing composition to be applied to the side walls and roof of a coke oven directly after coke has been pushed from the oven. There is no need for the oven to cool significantly before the composition is applied, nor to wait for the pusher machine to be moved away and another vehicle brought into position. Thus the invention saves time in applying patching or sealing composition, as well as avoiding damage to the oven. It is apparent that numerous modifications are possible, particularly in the location of various parts on the pusher machine.

We claim:

1. In a coking operation in which coke is produced in an oven having refractory side walls and roof, and completed coke is pushed from the oven with a pusher ram and ram head of a pusher machine, a method of patching or sealing cracks in the refractory, said method comprising subsequent to pushing of completed coke from the oven applying to the refractory a patching or sealing composition from nozzles located on the head of the pusher ram while the ram moves through the empty oven.

2. A method as defined in claim 1 wherein the composition is applied while projecting and retracting the ram through the empty oven with the composition discharging from the nozzles on at least one of the projecting and retracting strokes of the ram.

3. A method as defined in claim 2 including an additional step of purging the system after applying the composition to the refractory but before the head of the ram leaves the oven.

4. A method as defined in claim 2 in which the supply is turned on and the ram is projected immediately after the coke is pushed from the oven and the ram retracted following the pushing operation, whereby the oven does not cool significantly before the patching or sealing operation takes place.

5. The combination, with a coke pusher machine which includes a chassis, a pusher ram carried on said chassis for movement into and out of a coke oven, and a ram head on said ram, of an apparatus for applying patching or sealing composition to the side walls and roof of the oven, said apparatus comprising a gunning device supported on said chassis for containing a supply of the composition, a spray nozzle carried by said ram head, and means connecting said gunning device and said nozzle for carrying the composition from the gunning device to the nozzle.

6. A combination as defined in claim 5 in which said connecting means includes a flexible hose, means connecting said hose to said gunning device, and a pipe extending along said ram connected at its opposite ends to said hose and to said nozzle.

7. A combination as defined in claim 6 comprising in addition a reel mounting on said chassis and a pulley mounted on the back end of said ram, said hose winding on said reel and extending around said pulley.

8. A combination as defined in claim 5 comprising in addition means for purging said hose, pipe and nozzle with air after completion of a patching or sealing operation.

* * * * *